United States Patent [19]

Cumpston

[11] Patent Number: 4,457,147

[45] Date of Patent: Jul. 3, 1984

[54] COMBINATION LOCK

[76] Inventor: Edward H. Cumpston, 6 Stonehedge Dr., Bennington, Vt. 05201

[21] Appl. No.: 327,814

[22] Filed: Dec. 7, 1981

[51] Int. Cl.[3] ..... E05B 37/16

[52] U.S. Cl. ..... 70/213; 70/288; 70/299; 70/311; 70/319

[58] Field of Search ..... 70/297, 298, 299, 287, 70/288, 300, 311, 313, 319, 315, 213, 219

[56] References Cited

U.S. PATENT DOCUMENTS

| | | | |
|---|---|---|---|
| 2,083,782 | 2/1937 | Grubb | 70/299 |
| 3,196,643 | 7/1965 | Moss | 70/311 |
| 3,670,539 | 6/1972 | Marotte | 70/299 |
| 3,789,637 | 2/1974 | Schipper | 70/299 |

*Primary Examiner*—Robert L. Wolfe

*Attorney, Agent, or Firm*—Stonebraker, Shepard & Stephens

[57] ABSTRACT

A combination lock has an array of combination elements that are each movable between first and second positions. Each element 25 has to be in a preselected one of the two positions for the lock to open, and the combination is entered by either moving or not moving each element from an intial or reset position. Then a reader 30 adjacent the elements 25 is simultaneously moved against all the elements to test their positions. Any element not in the proper position blocks the reader from movement; but if all the elements are in their preselected positions, they allow the reader to move and the lock to open. Combination elements 25 are preferably arranged concentrically around a spindle 15 having an external knob 16 that can rotate and move the spindle axially. Each of the elements 25 is preferably a slidable plate with an eccentric notch 26 that confronts and overlaps with a radial notch in reader 30. As applied to a door lock 10, the working parts of the lock are mounted inside the door with only operating knob 16 located on the outside. Such an arrangement includes a sliding bolt 20 operated by spindle 15 after correctly completing the combination.

25 Claims, 13 Drawing Figures

COMBINATION LOCK

BACKGROUND

This invention springs from the problems and shortcomings of existing locks. It operates with a combination, because keys are troublesome; and it operates with a single knob, so it can be opened with one hand. Its combination uses detents so it can be operated by sound and feel and opened in the dark, and its single operating knob makes it tamperproof. It gives a potential intruder no clue about any combination setting and requires a complete combination sequence to be followed before the lock can be tried. It also offers a large number of combinational possibilities so that it is effectively secure against combination reading attempts. Finally, it combines all these features in a practical and economical lock that can be mass produced at low cost, made sturdy and reliable, and conveniently adjusted to any one of its many combinational possibilities.

SUMMARY OF THE INVENTION

My combination lock uses an array of combination elements that are each binary and movable between first and second positions so that each element of the array must be in a preselected one of the two possible positions for the lock to open. The combination is entered by either moving or not moving each element in the array and then moving a reader simultaneously against all the elements in the array to test their positions. Any element not in its preselected combination position blocks the reader from movement; but if all the elements are in their preselected positions, they allow the reader to move and the lock to open.

A preferred way of arranging the combination elements is concentrically around a spindle that can rotate and move axially. The spindle can rotate to each combinational position and can be either moved axially or not moved axially at each position for moving the elements to their preselected combinational positions. Each element is preferably a slidable plate with an eccentric notch confronting the reader and overlapping a notch in the reader so that the reader can turn with the spindle only when the element notches are all in the plane of the reader.

My lock can serve as a padlock or door lock; and as applied to a door, it locates all working parts securely on the inside of the door and disposes only a single operating knob on the outside of the door. It includes a sliding bolt operated by movement of the spindle after correctly completing a combination sequence.

DRAWINGS

DETAILED DESCRIPTION

Figure 1:
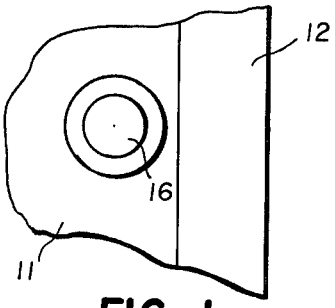
FIGS. 1 and 2 are fragmentary elevational views respectively of the outside and inside of a preferred door lock according to my invention and mounted on a door.
Figure 2:
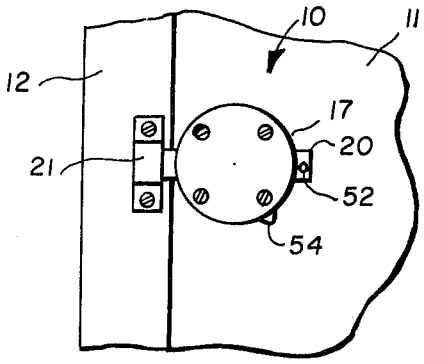

The preferred embodiment of my combination lock chosen for detailed illustration is arranged as a door lock 10 for a door 11 with a frame 12. An operating spindle 15 extends through door 11 and is manipulated by an external operating knob 16. The workings of the lock are mounted on the inside of door 11 in a housing 17. Lock 10 operates a sliding bolt 20 that is also manually operable from inside the door. Bolt 20 slides into a receiver 21 securely mounted on door frame 12 for locking door 11. The single external knob 16 accomplishes all the necessary operating functions for entering a combination, resetting the combination, and opening and closing bolt 20.

Figure 3:
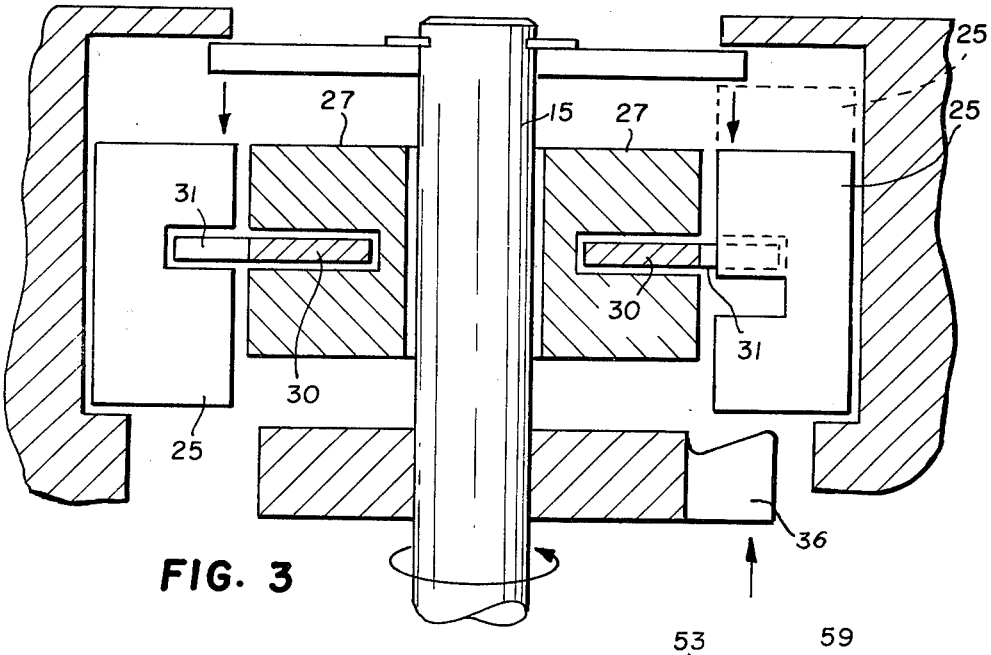
FIG. 3 is a fragmentary and schematic cross-sectional view of some of the workings of the lock of FIGS. 1 and 2.
Figure 4:
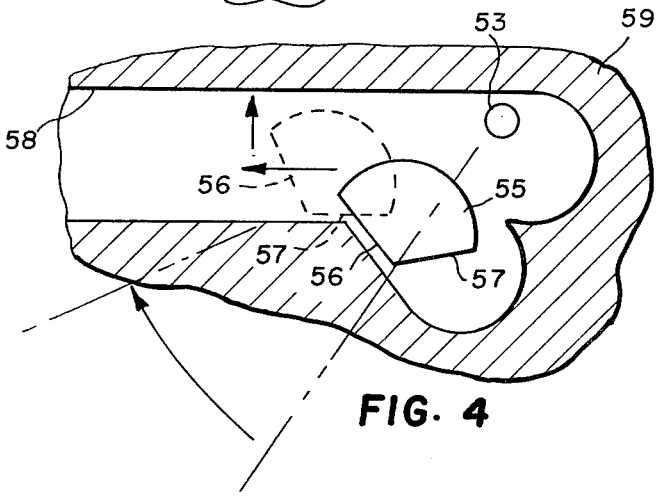
FIG. 4 is a schematic fragmentary view of the operation of the bolt latch for the lock of FIGS. 1 and 2.
Figure 5:
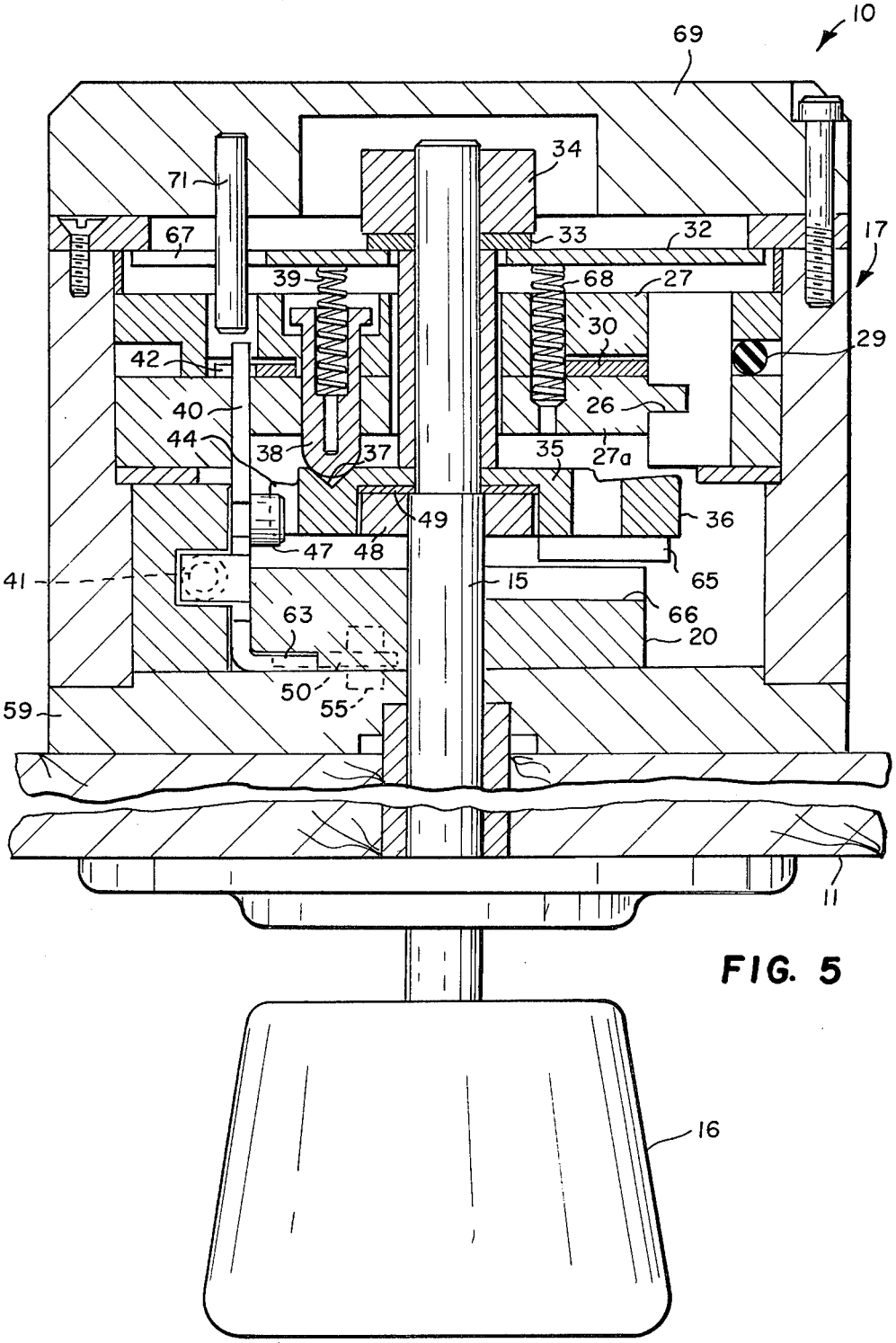
FIG. 5 is a cross-sectional view of a preferred embodiment of the door mounted lock of FIGS. 1–4.

Simplified schematics illustrating how lock 10 works are shown in FIGS. 3 and 4, and a preferred arrangement of the working parts for lock 10 are shown in the cross-sectional assembly view of FIG. 5. Higher numbered views show details of parts involved as explained below.

THE BINARY COMBINATION

Figure 6:
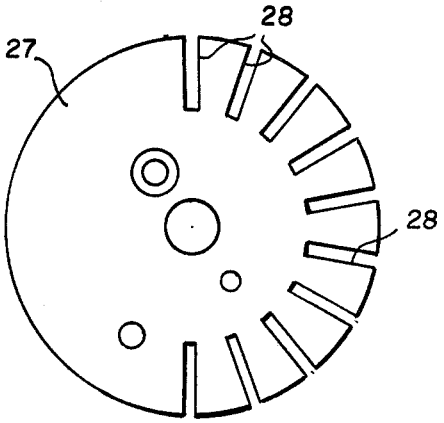
FIG. 6 is a plan view of a holder for the combination elements of the lock of FIG. 5.

The heart of lock 10 is an array of binary combination elements 25 and the mechanisms for operating these elements. Each element 25 can move between two positions, and opening the lock requires that each element be disposed in a preselected one of the two positions. Each element 25 is preferably formed as a plate with an eccentric notch movable axially of spindle 15, and elements 25 are preferably arrayed in an arc concentric with spindle 15. Elements 25 could also be lined up in a straight row or made to pivot, rather than slide, between two positions. Element plates 25 are loosely retained in radial slots 28 in a fixed holder 27 part of which is shown in FIG. 6 so that plates 25 can move axially of spindle 15 between their two positions. Holder 27 has a matching bottom part **27*a* as shown in FIG. 6, and holder parts 27 and 27*a* are similarly shaped for retaining plates 25 in radial slots 28. To keep plates 25 from moving freely or sliding out of their positions, a resilient band such as an O-ring 29 holds elements 25 against free axial movement within slots 28**.

Figure 7:
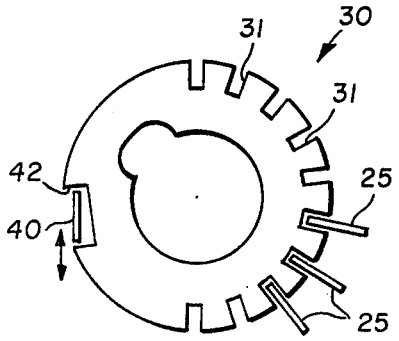
FIG. 7 is a plan view of a reader for testing the combination setting for the lock of FIG. 5.
Figure 9:
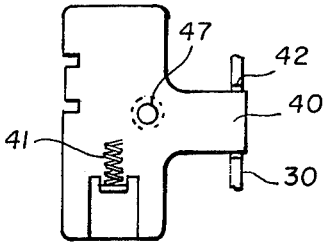
FIG. 9 is a front elevational view of a slide interconnecting the combination reader and operating element of the lock of FIG. 5.
Figure 8:
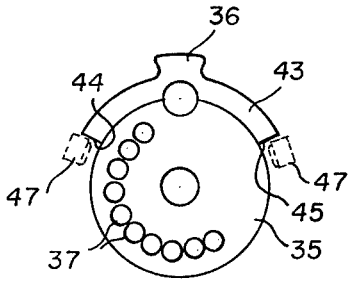
FIG. 8 is a plan view of an operating element for the lock of FIG. 5.
Figure 10:
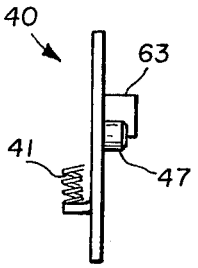
FIG. 10 is a side elevational view of the slide of FIG. 9.

Plates 25 have notches 26 that move axially of spindle 15 as plates 25 move between their binary positions. Notches 26 confront a reader 30 disposed between the halves of holder 27 and **27*a* in a fixed axial position relative to spindle 15, and notches 26 overlap with radial notches 31 in reader 30 as shown in FIG. 7. The overlap of notches 26 on plates 25 with notches 31 in reader 30 results in plates 25 blocking rotation of reader 30 unless notches 26 are disposed in the axial plane of reader 30**.

At the end of a combination entering sequence, reader 30 is urged rotationally against all of the combination elements 25 simultaneously to test the axial positions of their notches 26. The lock opens if reader 30 turns and remains locked if reader 30 is blocked. If all the notches 26 of all the plates 25 are positioned in the plane of reader 30, then reader 30 is free to rotate; but if any one of the plates 25 has its notch 26 out of the plane of reader 30, then that plate blocks any rotation of reader 30.

Plates 25 can be individually and selectively inverted to change the axial position of their eccentric notches 26. Notches 26 will align with the plane of reader 30 in one or the other position of each plate 25, depending on its orientation. Usually, when all of the plates 25 are reset to their first position, at least one of them is oriented to block rotation of reader 30, although this is not required. Entering a combination to open the lock requires that each element 25 blocking reader 30 in its first position be moved to its second position and that all elements 25 not blocking reader 30 in their first positions be left in their first positions.

Plates 25 are all moved to their first positions by a washer 32 surrounding spindle 15 and held by collar 33 and nut 34. Pulling spindle 15 outward by knob 16 resets the combination by moving washer 32 outward against the array of plates 25 and moving all of them to their outermost first positions.

ENTERING THE COMBINATION

To enter a combination and open the lock, an operating element 35 transmits motion from spindle 15 to any selected plate 25. Operating element 35 is mounted on spindle 15 for both rotation and axial movement; and for combination entering purposes, element 35 has a projection 36 that can be rotated into registry with any plate 25 and moved axially inward by spindle 15 to push any selected plate to its second position. Element 35 also has detent recesses 37 corresponding in number and spacing with plates 25, and a pin 38 biased by a spring 39 engaging washer 32 engages and detents in recesses 37 to make element 35 sensitive to combinational positions.

The coupling of operating element 35 to shaft 15 is preferably via a boss 48 fixed to shaft 15, and a friction washer 49 positioned between boss 48 and operating element 35. Bias force from nut 34 via resilient collar 33 presses operating element 35 against friction washer 49 so that normal operating force moves element 35 with spindle 15. Brute force on spindle 15 simply overcomes the frictional resistance of washer 49 and rotates spindle 15 harmlessly without turning element 35 so that lock 10 cannot be damaged by excessive force on knob 16.

Spring 39 also resists the axially inward movement of operating element 35 toward washer 32 and returns operating element 35 to its illustrated intermediate position. Springs 68 in holder 27 engage reset washer 32 and bias it against its illustrated rest position. Since holder 27 is fixed axially of spindle 15, springs 68 also return spindle 15 and knob 16 to the illustrated intermediate position after knob 16 has been pulled outward.

Operating of knob 16 for turning operating element 35 to different detented combinational positions and for moving projection 36 inward against a preselected plate 25 moves the plate's notch 26 axially. The combination of the lock is fulfilled by moving to the second position all of the plates that block movement of reader 30 in the first position and moving only those blocking plates. This positions all notches 26 in the plane of reader 30 and allows reader 30 to move.

Each element 25 is thus a binary combination element and must be either moved or not moved to enter a combination properly. Only when all combination elements 25 are preselectively disposed in either their first or second positions to bring all their notches 26 into the plane of reader 30 can lock 10 be opened. Inverting plates 25 to change the plane of their notches 26 relative to reader 30 determines which plates must be moved to fulfill the combination. Flexibility of the single O-ring tension band 29 encircling plates 25 makes plate inversion to change the combination simple and convenient.

Any number from none to all of the plates can require movement to enter a combination, and the combinational possibilities are $2^n$ with n equalling the number of combination elements used. The illustrated lock has 10 combination elements giving it 1,024 combinational possibilities. Increasing the number of plates 25 rapidly increases the number of possible combinations. For example, 12 plates allows 4,096 possibilities.

The combinations of rotating disk locks can be solved by placing a strain on the bolt while turning the combination knob to sense positions that relieve the strain. This is not possible with my lock because the single operating knob 16 offers no way to put a strain on the bolt while combination numbers are being set. There is no distinction in feel between any of the combination elements, and each one must be either moved or not moved before the reader can be turned to see whether the combination has been properly entered. Someone not knowing the combination has no clues that can be derived from knob 16 on which elements to move, and any trial and error solution promises to be time consuming because a full combination must be entered, tried, and then the combination elements reset for another full trial. Anyone attempting this cannot even tell how many elements need moving to fulfill the combination.

READING THE COMBINATION

Reader 30, as previously explained, can be urged against the concentric array of combination plates 25 and is free to turn if the notches 26 of the plates 25 are all in the plane of reader 30. This rotational movement of reader 30 is derived from spindle 15 via operating element 35 and a slide 40 as shown in FIGS. 7–10.

Slide 40 serves as a coupling element for transmitting motion and slides back and forth within holder 27 at the urging of operating element 35 to move reader 30 if plates 25 permit. A spring 41 biases slide 40 toward a home position, and slide 40 fits in a notch 42 in reader 30 so that slide 40 rotates reader 30 slightly as slide 40 moves back and forth in the direction of the arrows. Movement of slide 40 enabled by movement of reader 30 when the combination has been properly entered unlatches bolt 20 as described below.

Operating element 35 transmits moving force from spindle 15 to slide 40. An arcuate projection 43 on element 35 has ends 44 and 45 that engage a stud 47 on slide 40 at opposite extremes of rotational movement of element 35. Surface 44 of projection 43 hits stud 47 at one extreme of movement at the home position where the combination sequence begins; and when the combination sequence is completed, surface 45 at the other end of projection 43 hits the other side of slide stud 47 and moves slide 40 against the tension of spring 41 if reader 30 permits.

This arrangement insures that reader 30 tests the combination set by plates 25 only after the combination sequence is complete. There is no way for reader 30 to test combination elements individually and provide any feel for the proper setting of plates 25.

Figure 13:
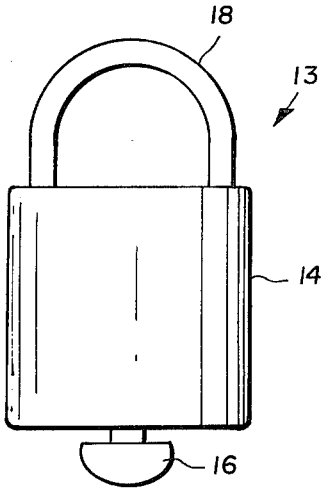
FIG. 13 is an elevational view of a padlock version of my lock.

As applied to a padlock such as shown in FIG. 13, movement of reader 30 can be arranged to unlatch U-bolt 18 and open the lock. As applied to sliding bolt door lock 10 shown in the other drawings, additional structure is required to operate the bolt.

BOLT OPERATION

Figure 11:
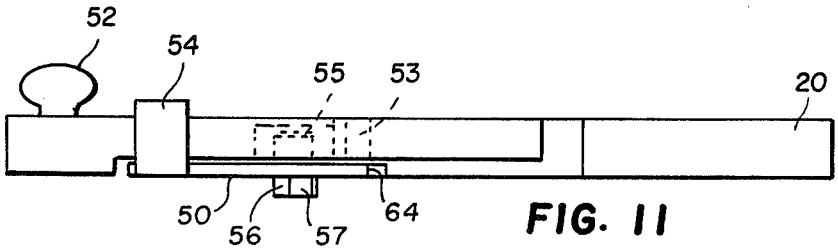
FIGS. 11 and 12 are respectively a side elevational view and a plan view of the bolt and latch for the lock of FIG. 5.
Figure 12:
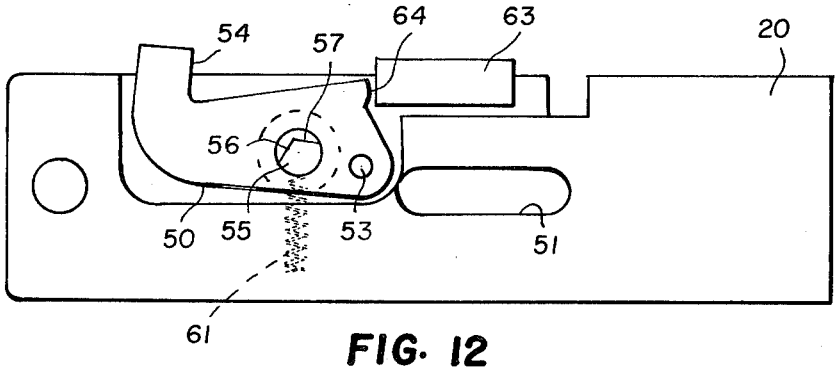

Bolt 20 as shown in FIGS. 4, 11, and 12 carries a latch 50, has a central slot 51 that slides astraddle spindle 15, and has a gripping notch or handle 52 on one end. The other end of bolt 20 locks in housing 21 mounted on a door frame as previously explained.

Latch 50 pivotally mounts on bolt 20 on a pin 53 and projects out of housing 17 to provide an inside latch release 54 that can be moved manually to unlatch bolt 20 from inside the door. Latch 50 also carries a latching pin 55 that is movable around pivot 53 and has a latching surface 56 and a holding surface 57. Latch pin 55 moves in a milled slot 58 in lock base 59 as best shown in FIG. 4. A spring 61 engages latch pin 55 to bias latch 50 toward a latching direction.

Slot 58 in base 59 has a side branch 62 that receives latch pin 55 when bolt 20 is fully closed. As bolt 20 slides toward the closed position, it carries latch 50 along with latch pin 55 sliding in slot 58 in base 59. When bolt 20 is fully closed, latch pin 55 reaches side branch 62 of slot 58, and spring 61 pivots latch 50 to move latching surface 56 into engagement with the side of branch slot 62. This latches bolt 20 against any retraction from the fully closed position.

To unlatch bolt 20, slide 40 is moved by operating element 35 when enabled by reader 30 as previously explained. Slide 40 has a projection 63 that engages a surface 64 of latch 50 and forces latch 50 to pivot enough to bring latch pin 55 into slot 58 that extends in the direction of bolt travel. This unlatches surface 56 of pin 55 from branching slot 62; but without something more, spring 61 would relatch pin 55.

To hold latch pin 55 unlatched, slide 40 presses further against latch 50 in response to rotation of spindle 15 to slide bolt 20 slightly away from the fully closed position. This moves latching pin 55 a short way down slot 58 as shown in broken lines in FIG. 4 and moves holding surface 57 against the side wall of slot 58, preventing relatching of pin 55. Bolt 20 is now unlatched and free to slide open.

To accomplish this, spindle 15 is turned in the opposite direction allowing slide 40 to return to its home position under the bias of spring 41, which also moves reader 30 back to its home position where its notches 31 register with combination elements 25. When this reverse rotation proceeds far enough to bring slide 40 and reader 30 home, a cam 65 on element 35 registers with a cam slot 66 in bolt 20. Outward pulling on knob 16 at this time moves spindle 15 outward to engage cam 65 in slot 66. Continued reverse rotation then rotates cam 65 in a direction to open bolt 20.

The outward movement of spindle 15 as cam 65 engages slot 66 also moves reset washer 32 outward and moves all the combination elements 25 to their first positions for resetting the combination automatically before bolt 20 opens. This makes it impossible to leave the lock accidentally with the combination set.

CHANGING THE COMBINATION

Lock 10 can be set for any combinational possibility simply by orienting combination plates 25. By removing cover 69, combination elements 25 become accessible through an opening 67 in reset washer 32. With cover 69 and its locating pin 71 removed, opening 67 can be rotated to register with any combination element 25, which then can be slid out of holder 27 and oriented to dispose its notch 26 either in the plane of reader 30 or out of the plane of reader 30 by inverting plate 25 end for end. O-ring tension band 29 allows plates 25 to be slid in and out readily.

After a new combination is set, washer 32 is returned to a home position where opening 67 aligns with registry pin 71 in cover 69. This keeps washer 32 from turning after the cover is replaced, so that washer 32 covers all the combination elements 25 and has its opening 67 disposed away from the combination element array.

PADLOCK VERSION

A simplified version of lock 10 can serve as a padlock 13 as shown in FIG. 13. The operating mechanisms for padlock 13 are contained within a cylindrical body 14, and operating knob 16 on the bottom of padlock 13 works in the same general way as it does with lock 10 to lock and release the U-shaped bar 18. Bolt 20, latch 50, and associated operating mechanisms are not necessary for padlock 13, which can be unlocked directly by movement of reader 30 or a latch enabled to move by reader 30. Otherwise, the same basic array of combinational elements 25, reader 30, operating element 35, spindle 15, and associated mechanisms all apply to padlock 13.

OPERATION

By pulling outward on knob 16 and rotating spindle 15 toward a home position, cam 65 engages cam slot 66 of bolt 20 and slides bolt 20 to a closed position where latch 50 latches against base 59 and holds the bolt latched. The outward movement required for doing this also pulls reset washer 32 against combination plates 25 to automatically reset the combination.

Beginning from a home position for spindle 15 and operating element 35, a person opening the lock turns the knob to move operating element 35 through its series of detent positions, pushing inward wherever appropriate to enter the combination by adjusting the positions of elements 25. When the combination entering sequence is properly fulfilled, reader 30 is allowed to turn as element 35 rotates further beyond the last combination entry position. This moves slide 40 against latch 50 and unseats bolt 20 to an unlatched position.

Then, by rotating knob 16 back toward the home position and pulling outward, cam 65 drops into cam slot 66 in bolt 20 and slides the bolt open as spindle 15 turns. Again, outward movement of spindle 15 automatically resets the combination. If the combination sequence is erroneously entered, the bolt will not unlatch; but the combination can be reset by pulling knob 16 outward and returning to a home position for another try at proper combination entry.

A pointer and numbers can be used in addition to or in place of the detent for operating element 35, but the detent is preferred for simplicity and effectiveness. The lock can also be made with any practical number of combination elements, and movement of any number of these can be required for fulfilling the combination.

Also, many structural and mechanical variations are possible in applying the basic working concepts of the invention to various locks. For example, the axial movement of spindle 15 can be functionally reversed for resetting the combination by pushing inward and selectively moving combination plates by pulling outward.

I claim:

1. A combination lock having an array of two-position combination elements, a reset means for simultaneously moving all of said elements into a first position, a reader arranged to be blocked from movement unless all of said elements are disposed in a preselected combination of said first and second positions, and entering means for moving preselected elements into said second position to fulfill said combination and allow said reader to move, said lock comprising:

a. a lock element movable between a locked and an unlocked position;

b. a movable latch carried on said lock element for holding said lock element in said locked position; and c. means responsive to movement of said reader after fulfilling said combination for unlatching said latch to allow movement of said lock element from said locked position.

2. The lock of claim 1 wherein said lock element is a sliding bolt.

3. The lock of claim 2 wherein said means responsive to movement of said reader also moves said bolt slightly to a position holding said latch in an unlatched position.

4. The lock of claim 3 wherein means for moving said reader also moves said bolt.

5. The lock of claim 1 arranged as a door lock with an operating knob arranged outside said door, said array of combination elements arranged inside said door and manually operable means arranged inside said door for unlatching said latch and moving said lock element from said locked position.

6. The lock of claim 5 wherein said lock element is a sliding bolt.

7. The lock of claim 6 wherein said means responsive to movement of said reader also moves said bolt slightly to a position holding said latch in an unlatched position.

8. The lock of claim 7 wherein means for moving said reader also moves said lock element.

9. A combination lock comprising:

a. a spindle that is rotatable and movable axially;

b. a knob arranged on an external portion of said spindle for operating said spindle;

c. movement of said spindle in one axial direction at different rotational positions being arranged for entering a combination;

d. a lock element movable between locked and unlocked positions;

e. movable latch means for latching said lock element in said locked position;

f. rotation of said spindle in one direction after properly entering said combination being arranged for unlatching said latch;

g. movement of said spindle in an opposite axial direction being arranged for resetting the combination of said lock; and h. rotation of said spindle in an opposite direction combined with movement in said opposite axial direction being arranged for moving said lock element from said locked position.

10. The lock of claim 9 wherein said lock element is a sliding bolt and said latch means is carried on said bolt.

11. The lock of claim 9 arranged for mounting on the inside of a door with said spindle extending through said door and said knob on the outside of said door.

12. The lock of claim 11 wherein said lock element is a sliding bolt and said latch means is carried on said bolt.

13. The lock of claim 12 including manually operable means arranged inside said door for unlatching said latch and sliding said bolt from said locked position.

14. The lock of claim 9 including means rotatable with said spindle for simultaneously reading all of said rotational combination positions for determining fulfillment of said combination and wherein said reading means is enabled to move with said spindle rotationally beyond said combination positions for unlatching said latch if said combination is properly entered.

15. The lock of claim 14 including means responsive to rotation of said spindle in said one direction after properly entering said combination for moving said bolt slightly to a position holding said latch in said unlatched position.

16. The lock of claim 15 wherein said lock element is a sliding bolt and said latch means is carried on said bolt.

17. The lock of claim 16 arranged for mounting on the inside of a door with said spindle extending through said door and said knob on the outside of said door.

18. The lock of claim 17 including manually operable means arranged inside said door for unlatching said latch and sliding said bolt from said locked position.

19. A combination door lock comprising:

a. a lock body mounted on the inside of said door;

b. a sliding bolt mounted in said lock body for movement between locked and unlocked positions for locking said door;

c. a spindle extending from said lock body through said door;

d. an operating knob on said spindle outside said door;

e. said spindle being rotatable and movable axially;

f. an array of combination elements coaxial with said spindle;

g. said combination elements being movable axially of said spindle between first and second positions;

h. reset means movable axially with said spindle in a reset direction to move all of said combination elements to said first position;

i. a reader concentric with said spindle and rotatable with said spindle;

j. said reader being disposed adjacent said elements in said array and configured for simultaneously rotating against all of said elements;

k. said elements being arranged for blocking said reader from rotation unless all of said elements are disposed in a preselected combination of said first and second positions and for allowing said reader to rotate when all of said elements are disposed in said preselected combination of said first and second positions;

l. an entering device rotatable with said spindle for registering with preselected elements and movable axially with said spindle in an entering direction opposite to said reset direction for moving a preselected combination of said elements into said second position to fulfill said combination and allow said reader to move;

m. a movable latch carried on said bolt for latching said bolt in said locked position; and n. a slide enabled by movement of said reader and moved by said spindle for unlatching said latch to allow movement of said bolt from said locked position.

20. The lock of claim 19 wherein said entering means includes a cam for opening and closing said bolt, and said spindle moves axially in said reset direction to engage said cam and said bolt for moving said bolt from said locked position and simultaneously moves said combination elements to said first position.

21. The lock of claim 20 wherein said slide is arranged for moving said bolt slightly to a position that holds said latch in an unlatched state, and reverse rotation of said spindle is operable for opening said bolt.

22. The lock of claim 21 including a cam rotatable with said spindle for engaging said bolt for opening and closing said bolt.

23. The lock of claim 22 wherein said cam is mounted on said entering means and said spindle moves axially in said reset direction for engaging said cam with said bolt for moving said bolt from said locked position and simultaneously resetting said combination elements in said first position.

24. The lock of claim 19 including manually operable means arranged inside said door for unlatching said latch and sliding said bolt from said locked position.

25. The lock of claim 24 wherein said entering means includes a cam for opening and closing said bolt, and said spindle moves axially in said reset direction to engage said cam and said bolt for moving said bolt from said locked position and simultaneously moves said combination elements to said first position.

* * * * *